US006648335B1

(12) United States Patent
Ezell

(10) Patent No.: US 6,648,335 B1
(45) Date of Patent: Nov. 18, 2003

(54) METAL-TO-METAL SEAL ASSEMBLY FOR OIL AND GAS PRODUCTION APPARATUS

(76) Inventor: Michael D. Ezell, 1203 Rooney La., Carrollton, TX (US) 75007

( * ) Notice: Subject to any disclaimer, the term of this patent is extended or adjusted under 35 U.S.C. 154(b) by 0 days.

(21) Appl. No.: 09/185,220

(22) Filed: Nov. 3, 1998

(51) Int. Cl.[7] ..... F16J 15/40

(52) U.S. Cl. ..... 277/438; 277/437; 166/387; 166/84.1

(58) Field of Search ..... 277/438, 437, 277/310, 311; 166/383, 381, 387, 84.1; 285/917, 101, 121.2; 92/108

(56) References Cited

U.S. PATENT DOCUMENTS 5,044,672 A * 9/1991 Steels et al. ..... 285/98
5,213,340 A * 5/1993 Azibert ..... 277/27
5,277,253 A * 1/1994 Giroux et al. ..... 166/187
5,331,884 A * 7/1994 Ando ..... 277/DIG. 8
5,662,180 A * 9/1997 Coffman ..... 175/57
5,662,341 A * 9/1997 Ezell ..... 277/27
5,735,344 A * 4/1998 Duncan ..... 166/381
6,032,958 A * 3/2000 Fowler ..... 277/337
6,050,544 A * 4/2000 Meronek ..... 285/332.1

* cited by examiner

*Primary Examiner*—Anthony Knight
*Assistant Examiner*—Mark Williams

(57) ABSTRACT

A metal-to-metal seal assembly provides a dynamic seal between a piston and a cylinder. A first seal engages the inner diameter of the piston, while a second seal engages an outer diameter of the piston. The piston is disposed between an inner mandrel and an outer tubular member that form an annular space therebetween. The seal uses a hollow seal ring is provided having a "C"-shaped cross section and containing a coiled spring. The seals form an interference fit against the mandrel and tubular member.

25 Claims, 3 Drawing Sheets

METAL-TO-METAL SEAL ASSEMBLY FOR OIL AND GAS PRODUCTION APPARATUS

BACKGROUND OF THE INVENTION

1. Technical Field of the Invention

The present invention relates to a metal-to-metal seal assembly and, more particularly, to such an assembly for use in oil and gas production apparatus located in a well.

2. Description of Related Art

It is critically important to properly seal certain components in oil and gas wells during the operation of downhole tools, after completion and testing of the well, and during production. For example, expansion joints, often referred to as "polished bore receptacles," can be connected in the production tubing string in a completed well to compensate for changes in the axial length of the tubing string due to the effects of relatively large temperature changes in the well. Failure to compensate would otherwise cause a compression deformation or tensile failure. A typical polished bore receptacle includes two tubular members disposed in a telescoping relationship that is move relatively to each other in an axial direction in response to temperature variations, and a continuous dynamic seal is provided between the two members to prevent fluid leakage between the sliding surfaces of the two members.

Elastomer seals have been used in a variety of sealing applications in oil and gas wells, including use in the polished bore receptacles described above. However, the elastomer may lose its resiliency or shape memory after some use, which is necessary for the seal to oppose the imposed forces thereon. Also, elastomer seals tend to deteriorate with exposure to the downhole chemical and relative high temperature environments for long periods of time. Further, significant abrasion of the seal material will occur by the forces generated when there is relative movement between the two members being sealed, as is the case with polished bore receptacles. Although these deficiencies can be compensated for to a certain degree by preloading the seal, the preloading force becomes less as more and more of the seal material abrades, ultimately causing seal leakage and failure.

Therefore, to overcome these problems, metal-to-metal seals have evolved since they, for the most part, do not lose their resiliency and shape memory and are not affected by hostile environments. However, metal-to-metal seals are normally only used as static seals or as safety backup seals since the seal must remain stationary and must be under constant compression to insure that it is not compromised. Therefore, these metal-to-metal seals are not suitable for use in dynamic sealing applications, including the polished bore receptacles described above.

Prior art patents have addressed the need for metal-to-metal seals to some extent. For example, U.S. Pat. No. 5,662,341 which issued to the present inventors, discloses an earlier type of metal to metal seal assembly. FIGS. 1 and 2 illustrate this prior art seal. Referring to FIG. 1 of the drawings, the reference numeral 10 refers in general, to the expansion joint, or polished bore receptacle, of the present invention which is adapted to be connected between two tubular sections (not shown) forming a portion of production tubing string in an oil or gas well. The assembly 10 consists of an inner mandrel 12 telescopically received in an outer tubular member 14. It is understood that the inner bore of the outer tubular member 14 is polished and that the entire lengths of the overlapping end portions of the mandrel 12 and the tubular member 14 are not shown in their entirety for the convenience of presentation.

The respective distal end portions of the mandrel 12 and the tubular member 14 are threaded for connection to the two tubular sections of the tubing string (not shown) in coaxial alignment. The respective inner bores of the mandrel 12, the tubular member 14 and the tubing string sections are aligned in a coaxial relationship and thus provide a continuous passage for the flow of production fluid upwardly, as viewed in FIG. 1, through the lower portion of the tubing string, the tubular member 14, the mandrel 12 and the upper portion of the string.

The mandrel 12 has a stepped outer surface and the tubular member 14 has a stepped inner surface. As a result, a shoulder 12*a* is defined on the outer surface of the mandrel 12 which, in the assembled condition of the assembly 10 as viewed in FIG. 1, abuts against a corresponding shoulder formed on the tubular member 14. An annular cross-sectional space is defined between the outer surface of the mandrel 12 and the inner surface of the tubular member 14, which space extends below the shoulder 12*a* and the corresponding shoulder of the tubular member 14. The reference numeral 14*a* refers to a shoulder defined on the inner surface of the tubular member 14 at which the inner diameter of the latter member increases in a direction from the upper portion to the lower portion, for reasons to be described.

A locking mandrel 16 extends over the upper end portion of the tubular member 14 and has a inwardly-directed flange 16*a* which engages the end of the latter member. A plurality of angularly-spaced, radially-extending openings 16*b* (only one of which is shown in the drawing) are formed through the locating mandrel 16 and align with corresponding openings in the tubular member 14 and the mandrel 12. A plurality of pins 18 are provided which, during assembly, pass through the openings 16*a* respectively, and extend in the respective aligned openings in the tubular member 14 and the mandrel 12. This locates the mandrel 12 relative to the tubular member 14 in the position shown and prevents relative axial movement therebetween. The pins 18 are adapted to shear in response to a predetermined shear force between the mandrel 12 and the tubular member 14, in a conventional manner. A threaded pin 20 extends through a threaded opening in the locating mandrel 16 and into a notch 14*b* formed in the upper surface of the tubular member 14 to secure the locating mandrel to the member.

A bearing ring 24 extends around the mandrel 12 and in the annular space between the mandrel 12 and the tubular member 14. A wire ring 26 is used to secure the bearing ring 24 in the position shown. Another bearing ring 28 also extends around the mandrel 12, in the latter annular space, and above the bearing ring 24 in a slightly spaced relation thereto.

A seal ring 30 extends around the mandrel 12, in the annular space between the mandrel 12 and the tubular member 14, and between the bearing rings 24 and 28. As better shown in FIG. 2, the seal ring 30 has a substantially "C"-shaped cross section and, in the assembled portion shown in FIG. 1, the open portion of the C faces downwardly, i.e., in a direction facing the production fluid as it flows upwardly through the assembly 20. The "C" configuration defines two parallel sections 30*a* and 30*b* which abut the tubular member 14 and the mandrel 12, respectively, as will be described in further detail. The seal ring 30 is preferably fabricated from a metal material, and the height of the ring is slightly more than the height of the annular space between the mandrel 12 and the tubular member 14 in the portion of the annular gap in which the ring 30 is installed.

A coiled spring 32 is disposed within the seal ring 30 and extends for its entire circumference. The purpose of the spring 32 is to preload the seal ring 30 as will be described.

A coiled spring 32 is disposed within the seal ring 30 and extends for its entire circumference. The purpose of the spring 32 is to preload the seal ring 30 as will be described. The seal ring 30 has a major diameter defining its circumference, as well as a cross sectional diameter which defines the cross-sectional area of the seal ring 30.

The assembly 10 is assembled by initially placing the bearing ring 24 over the outer surface of the mandrel 12 and aligning the groove in the inner surface of the ring 24 with the complementary groove in the outer surface of the mandrel 12. The wire 26 is then threaded through a tap or opening (not shown), in the ring 24 and into the aligned grooves to secure the ring 24 against axial movement relative to the mandrel 12. The seal ring 30 and the bearing ring 28 are then advanced over the mandrel 12 until the seal ring extends between the bearing rings 24 and 28 in close proximity thereto. The mandrel 12 is then inserted, or stabbed, into the upper end of the tubular member 14, with the mule shoe guide 34 aiding in properly aligning the mandrel and the tubular member. The mandrel 12 is then advanced relatively to the tubular member 14 in a downward direction as viewed in FIG. 1 until the shoulder 12*a* of the mandrel 12 abuts the corresponding shoulder of the tubular member 14. During this movement, the bearing rings 24 and 28 and the seal ring 30 pass the shoulder 14*a* of the tubular member 14 and thus encounter the above-mentioned portion of the inner surface of the tubular member 14 in which the inner diameter of the latter member increases and the height of the annular space between the mandrel 12 and the tubular member 14 is slightly less that the height of the cross section of the ring 30. Thus, when the mandrel reaches its assembled position shown in FIG. 1, the ring 30 is secured between the mandrel and the tubular member in a strong interference fit. The locking mandrel 16 is then placed over, and secured to, the end portion of the tubular member 14, and the shear pins 18 are inserted into their respective aligned openings to secure the assembly 10 in its assembled position, ready for installation in the well.

In operation, the assembly 10 is assembled in the manner discussed above and is connected between two sections of production tubing and lowered into the well to be serviced. The production fluid passes upwardly through the continuous bore established by the respective bores of the lower tubular string, the tubular member 14, the mandrel 12 and the upper tubular string. The assembly 10 expands and contracts in an axial direction as a result of corresponding relative telescoping movement between the mandrel 12 and the tubular member 14 in response to corresponding changes in the temperature in the well.

Although the fluid will attempt to enter the annular space between the mandrel 12 and the tubular member 14, the seal ring 30, with assistance from the bearing rings 24 and 28, prevents any ingress. More particularly, and with reference to FIGS. 1 and 2, the fluid will enter the opening defined in the "C" cross section of the ring, i.e., between the respective ends of the sections 30*a* and 30*b*. The fluid pressure acting against the seal ring 30 will be constant in the center of the "C" shaped cross-sectional portion of the ring, as well as between the tubular member 14 and the section 30*a* of the ring, and between the mandrel 12 and the section 30*b* of the ring. Also, the ring 30 is secured between the mandrel 12 and the tubular member 14 in a strong interference fit and the spring 32 functions to maintain the shape of the ring 30 during loading. As a result of all of this, the sections 30*a* and 30*b* of the ring 30 are prevented from getting bent radially inwardly away from the tubular member 14 and the mandrel 12, respectively, thus preventing collapsing of the ring. Thus, the pressure across the annular gap between the mandrel 12 and the tubular member 14 is equal and a strong seal is established. Also, the seal ring 30 is adapted for slight movement up and down as needed to accommodate the relative axial movement of the mandrel 12 and the tubular member 14.

There are times when a moving piston must be appropriately sealed. Thus, a need exists for a metal-to-metal piston system that allows for the application of a piston conveyed force to be applied to a linearly moving body while maintaining a metal to metal seal between-the piston and the outer and inner cylinders. The metal to metal seal will keep a constant load against the piston and the cylinder throughout the full stroking operation of the piston.

SUMMARY OF THE INVENTION

This metal-to-metal piston system allows for the application of a piston conveyed force to be applied to a linearly moving body while maintaining a metal to metal seal between the piston and the outer and inner cylinders. The metal to metal seal will keep a constant load against the piston and the cylinder throughout the full stroking operation of the piston.

This metal to metal piston system consists of a metal ring with metal to metal seals on both the outer diameter and the inner diameter. This piston will be installed inside a cylinder and it will have a shaft run inside of it. When assembled in this manner, the metal seals on the piston inner diameter will form an interference seal between the piston's outer diameter and the cylinder's inner diameter. Application of pressure on the lower end of the piston will cause the piston to travel linearly inside the cylinder. This system also contains elastomeric O-rings above the piston. These O-rings are used as wipers to maintain a clean surface for the metal to metal seals to seal on during the travelling process. The seal will also be maintained once the piston has traveled to its full extent.

The conventional method for sealing the piston between the cylinder and the shaft is with the use of elastomeric O-rings. These O-rings can degenerate through exposure to well fluids. Over extended periods of time, these O-rings seals can also loose sealing integrity. Elastomeric seals are also adversely effected by temperature fluctuations. The metal seals that are used in the metal to metal sealing piston system, on the other hand, are much more resilient to well fluids and temperature fluctuations.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DESCRIPTION OF THE PREFERRED EMBODIMENTS

Figure 3:
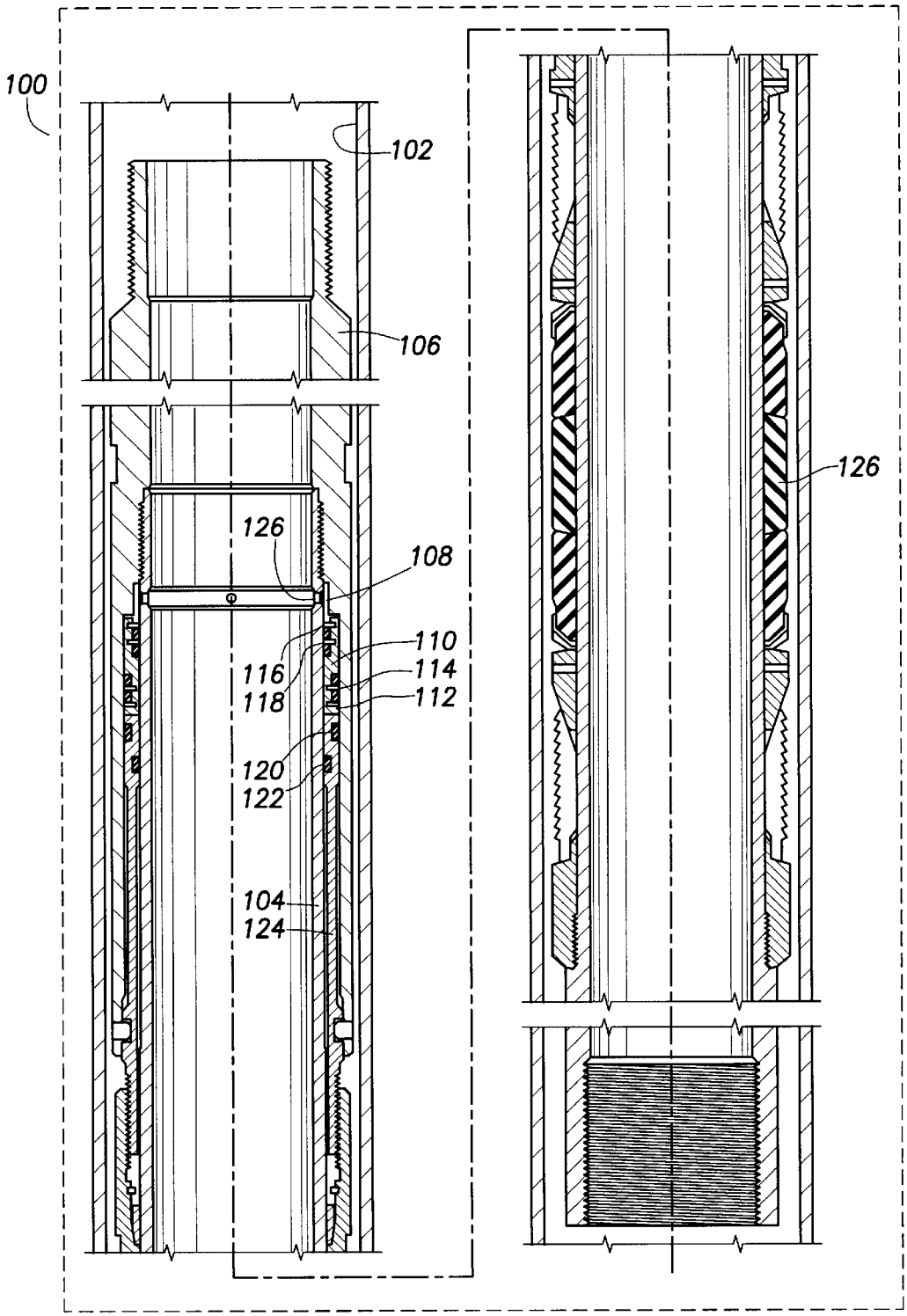
FIG. 3 is a full sectional view of the present metal-to-metal sealing system applied to a piston in a non-engaged position.

FIG. 3 is a sectional view of the present metal-to-metal sealing system 100. The system 100 consists of an inner mandrel 104 telescopically received in an outer tubular member 106. The respective distal end portions of the mandrel 104 and the tubular member 106 are threaded for connection to the two tubular sections of the tubing string (not shown) in coaxial alignment. The assembly of the inner mandrel 104 and the tubular member 106 can also be referred to as a cylinder. The respective inner bores of the mandrel 104, the tubular member 106 and the tubing string sections are aligned in a coaxial relationship and thus provide a continuous passage for the flow of production fluid upwardly. The assembly can be located in a well. It is common for such wells to be cased 102. It is understood that a plurality of packing seals and molded seals could be located between the inner mandrel 104 and the tubular member 106 including those portions thereof that are not shown in the drawings.

An annular cross-sectional space 108 is defined between the outer surface of the mandrel 104 and the inner surface of the tubular member 106. A piston 110 can be located within the annular space 108. The piston, or any other linearly moving body, can travel between an upper or non-engaged position to a lower or engaged position. The piston 110 has an outer diameter as well as an inner diameter. The outer diameter has a first indent 112 for receiving a first metal-to-metal seal 114. The inner diameter of the piston has a second indent 116 for receiving a second metal-to-metal seal 118. Further, the piston 110 can use a first and second o-ring 120, 122 as a wiper to clean the bore. A shaft 124 can be located next to the piston 110 so that movement of the piston results in the linear movement of the shaft 124. In this illustration, the piston is used to actuate an elastomeric packer 130, 126.

Figure 1:
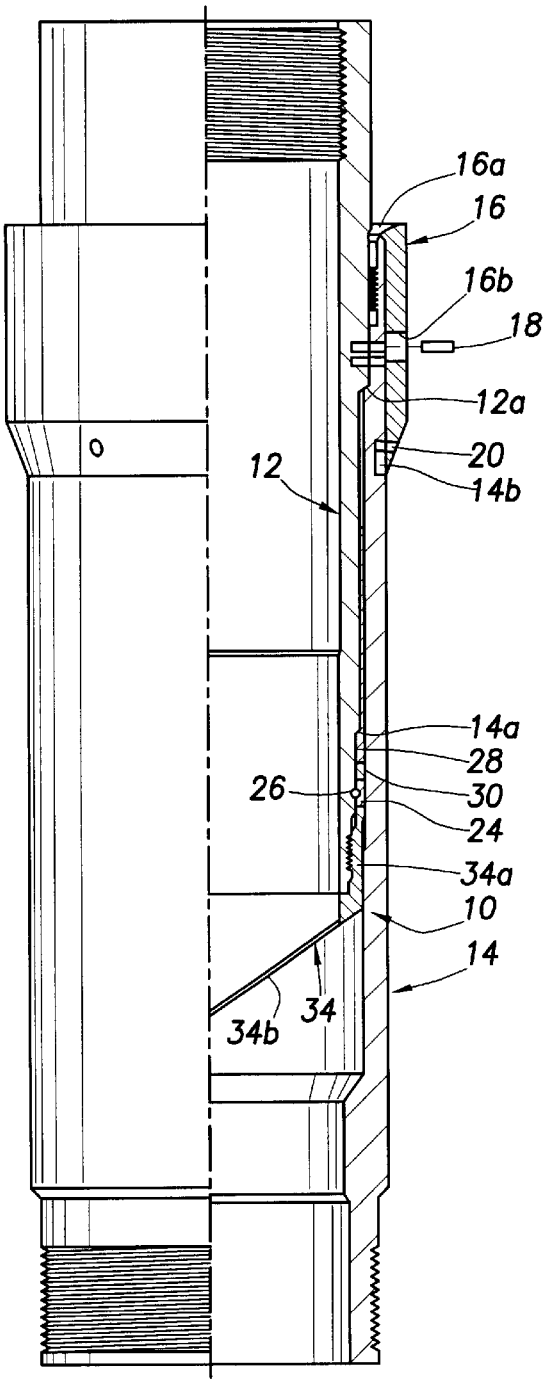
FIG. 1 (PRIOR ART)
FIGS. 1 and 2 illustrate a prior art metal to metal system.
Figure 2:
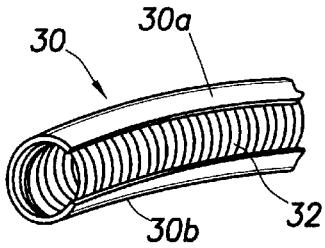
FIG. 2 (PRIOR ART)

The metal-to-metal seals 114, 118 are similar to those disclosed in U.S. Pat. No. 5,662,341 and discussed above in reference to FIG. 2. When the annular space above the piston 110 is pressurized, the piston 110 assembly is forced downward. The annular space can be selectively-pressurized through port 126. The metal seals 114 on the piston 110 inner diameter will form an interference seal between the piston's outer diameter and the cylinder's inner diameter. Application of pressure on the lower end of the piston will cause the piston to travel linearly inside the cylinder. This system also contains elastomeric O-rings 120, 122 to maintain a clean surface for the metal to metal seals to seal on during the travelling process.

Figure 4:
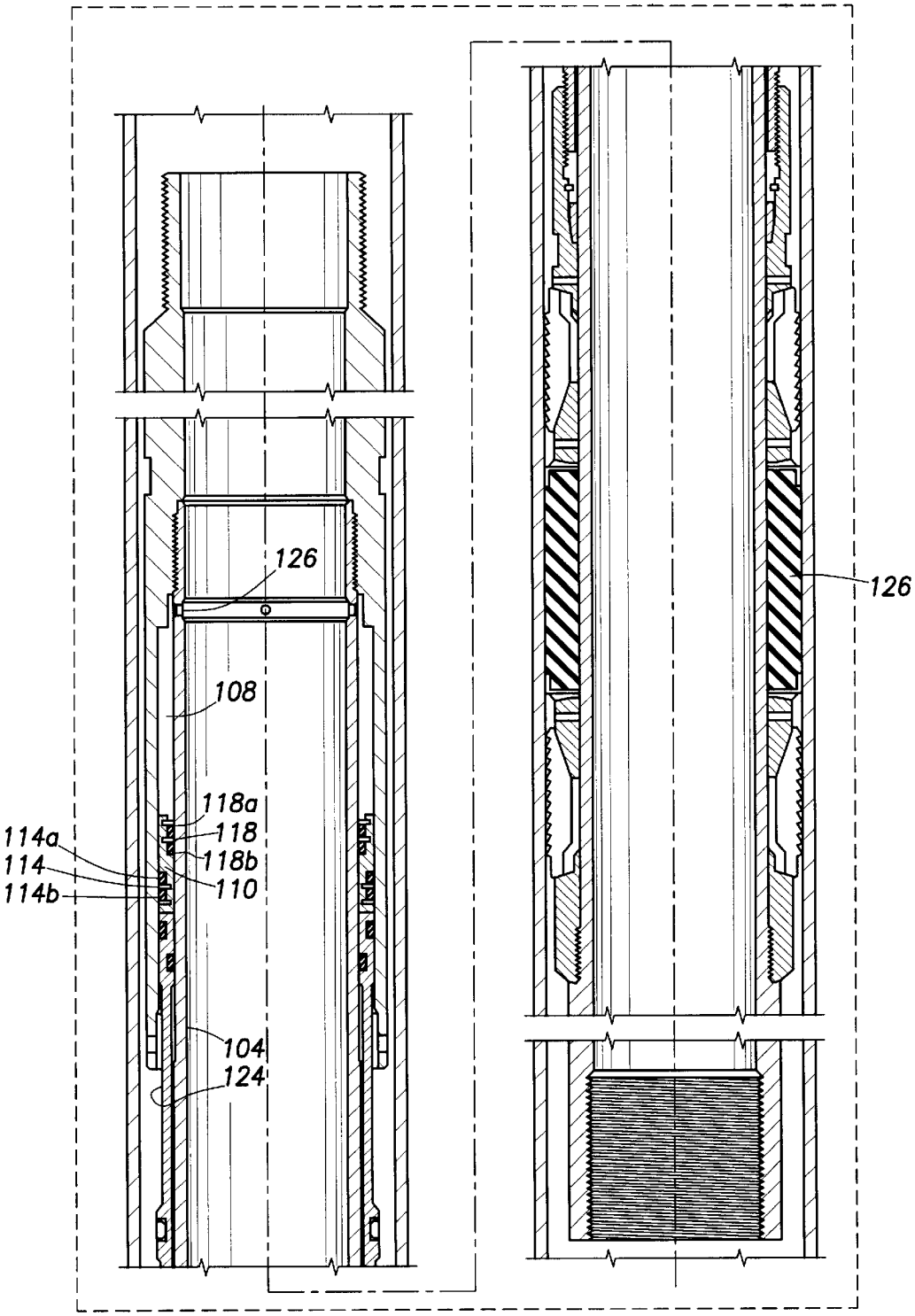
FIG. 4 a full sectional view of the present metal-to-metal sealing system applied to a piston in an engaged position.

FIG. 4 illustrates the present metal-to-metal seal system in an extended, downward, or engaged position. Note that the piston 110 has moved downward in the annular space 108. The inner diameter seal 118 has maintained an interference fit against the outer diameter of the inner mandrel 04. The seal 118 can include a first and second coiled spring assembly 118*a*, 118*b* such as that shown in FIG. 2. Likewise, the seal 114 can include a first and second coiled spring assembly 114*a*, 114*b* such as that shown in FIG. 2.

It is understood that other modifications, changes and substitutions are intended in the foregoing disclosure and in some instances some features of the invention will be employed without a corresponding use of other features. Accordingly, it is appropriate that the appended claims be constructed broadly and in a manner consistent with the scope of the invention.

What is claimed is:

1. A piston assembly providing a dynamic fluid seal comprising:

(a) a piston captured within an annular space between a first hollow cylinder co-axially aligned with a second hollow cylinder; wherein each of said piston, first cylinder and second cylinder have an inner diameter and an outer diameter, (b) a first and a second metal-to-metal seal engaged against the piston's inner diameter and said first cylinder's outer diameter; and (c) a third and a fourth metal-to-metal seal engaged against the piston's outer diameter said the second cylinder's inner diameter; wherein the first and second metal-to-metal seals have a rigid major diameter.

2. The piston assembly of claim 1 wherein said piston's inner diameter comprises a notch for receiving said first and said second metal-to-metal seal.

3. The piston assembly of claim 1 wherein said piston's outer diameter comprises a notch for receiving said third and said fourth metal-to-metal seal.

4. The piston assembly of claim 1 wherein said metal-to-metal seals comprise:

(a) a hollow seal ring extending between said piston and the first and second hollow cylinders in an interference fit and having a cross-sectional area defining an opening, (b) the ring being configured and positioned relative to the first and second hollow cylinders for receiving into the cross-sectional area fluid to be sealed to equalize the fluid pressure across the seal ring.

5. The piston assembly of claim 4 wherein the cross section of the seal ring is "C" shaped and defines two parallel sections which respectively abut the first hollow cylinder and the piston and the second hollow cylinder and the piston in an interference fit.

6. The piston assembly of claim 4 further comprising a coiled spring disposed in the opening in the seal ring.

7. The piston assembly of claim 4 wherein the first and second hollow cylinders may move relative to each other subsequent to the assemblage of the metal-to-metal seals for operation.

8. The piston assembly of claim 4 wherein the piston is free to move relative to the first and second hollow cylinders during operation of the seal.

9. The piston assembly of claim 1 further comprises a shaft located adjacent to said piston.

10. An assembly utilizing metal-to-metal seals comprising:

(a) a piston contained between a first hollow cylinder and a second hollow cylinder; wherein an annular space is defined therebetween, and wherein said piston can move linearly within said annular space;

(b) a first metal-to-metal seal engaged against an inner diameter of said piston and an outer diameter of said first cylinder;

(c) a second metal-to-metal seal engaged against an outer diameter of said piston and an inner diameter of said second cylinder;

(d) a shaft located distally from said piston in said annular space and separate from said piston;

wherein the first and second seals have a rigid major diameter.

11. The assembly of claim 10 further comprises at least one O-ring engaged to the outer diameter of said piston and the inner diameter of said second cylinder.

12. The assembly of claim 10 further comprises at least one O-ring engaged to the shaft.

13. The assembly of claim 10 wherein said metal-to-metal seal comprises:

(a) a hollow seal ring extending between said piston and the first and-second hollow cylinders in an interference fit and having a cross-sectional area defining an opening, (b) the ring being configured and positioned relative to the first and second hollow cylinders for receiving into the cross-sectional area fluid to be sealed to equalize the fluid pressure across the seal ring.

14. A method of sealing a piston captured within an annular space between a first hollow cylinder co-axially aligned with a second hollow cylinder comprising the steps of:

(a) engaging a first and a second metal-to-metal seal between an inner diameter of the piston and an outer diameter of the first cylinder;

(b) engaging a third and a fourth metal-to-metal seal between an outer diameter of the piston and an inner diameter of the second cylinder; wherein the first and second seals have a rigid major diameter.

15. The method of claim 14 further comprises:

(c) positioning a shaft distally to said piston in said annular space.

16. The method of claim 14 further comprises:

(c) actuating a device in response to movement of said piston.

17. The method of claim 15 further comprises:

(d) engaging at least one O-ring around the shaft.

18. A downhole actuation device comprising:

(a) a piston captured within an annular space between a first hollow cylinder co-axially axially aligned with a second hollow cylinder and responsive to an actuation pressure; wherein said piston, first cylinder and second cylinder each have an inner diameter and an outer diameter, (b) a first metal-to-metal seal engaged against the piston's inner diameter and said first cylinder's outer diameter;

(c) a second metal-to-metal seal engaged against the piston's outer diameter said the second cylinder's inner diameter; wherein the first and second seals have a rigid major diameter;

(d) a shaft located distally from said piston in said annular space and separate from said piston; and (e) means for selectively pressurizing said annular space.

19. The downhole actuation device of claim 18 wherein said piston's inner diameter comprises a notch for receiving said first metal-to-metal seal.

20. The downhole actuation device of claim 18 wherein said piston's outer diameter comprises a notch for receiving said second metal-to-metal seal.

21. The downhole actuation device of claim 18 wherein said metal-to-metal seals comprise:

(a) a hollow seal ring extending between said piston and the first and second hollow cylinders in an interference fit and having a cross-sectional area defining an opening, (b) the ring being configured and positioned relative to the first and second hollow cylinders for receiving into the cross-sectional area fluid to be sealed to equalize the fluid pressure across the seal ring.

22. The downhole actuation device of claim 21 wherein the cross section of the seal ring is "C" shaped and defines two parallel sections which respectively abut the first hollow cylinder and the piston and the second hollow cylinder and the piston in an interference fit.

23. The downhole actuation device of claim 21 further comprising a coiled spring disposed in the opening in the seal ring.

24. The downhole actuation device of claim 21 wherein the first and second hollow cylinders may move relative to each other subsequent to the assembly of the metal-to-metal seals for operation.

25. The downhole actuation device of claim 21 wherein the piston is free to move relative to the first and second hollow cylinders during operation of the seal.

* * * * *